US007115345B2

(12) United States Patent
Ioannidis et al.

(10) Patent No.: US 7,115,345 B2
(45) Date of Patent: Oct. 3, 2006

(54) ELECTROPHOTOGRAPHIC IMAGING MEMBERS

(75) Inventors: Andronique Ioannidis, Webster, NY (US); Timothy J. Fuller, Pittsford, NY (US); Nancy L. Belknap, Rochester, NY (US); Markus R. Silvestri, Fairport, NY (US); Cindy C. Chen, Rochester, NY (US); Timothy P. Bender, Port Credit (CA); John F. Graham, Oakville (CA); James M. Duff, Mississauga (CA); Kenny-Tuan T. Dinh, Webster, NY (US); John F. Yanus, Webster, NY (US); James M. Markovics, Rochester, NY (US); Lanhui Zhang, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 253 days.

(21) Appl. No.: 10/780,056

(22) Filed: Feb. 17, 2004

(65) Prior Publication Data

US 2005/0266326 A1 Dec. 1, 2005

(51) Int. Cl.
*G03G 5/47* (2006.01)

(52) U.S. Cl. ..... 430/58.15; 430/58.25; 430/58.65; 430/58.85; 430/59.1; 430/59.4; 430/59.6

(58) Field of Classification Search ..... 430/58.15, 430/58.05, 58.25, 58.65, 58.85, 59.1, 59.4, 430/59.6

See application file for complete search history.

(56) References Cited

U.S. PATENT DOCUMENTS

| | | | | |
|---|---|---|---|---|
| 4,457,994 | A | 7/1984 | Pai et al. | |
| 4,599,286 | A | 7/1986 | Limburg et al. | |
| 4,871,634 | A | 10/1989 | Limburg et al. | |
| 5,368,967 | A | 11/1994 | Schank et al. | |
| 5,418,107 | A | 5/1995 | Nealey et al. | |
| 5,681,679 | A | 10/1997 | Schank et al. | |
| 5,702,854 | A | 12/1997 | Schank et al. | |
| 5,709,974 | A | 1/1998 | Yuh et al. | |
| 6,197,464 | B1 | 3/2001 | Dinh et al. | |
| 6,207,334 | B1 | 3/2001 | Dinh et al. | |
| 6,242,144 | B1 | 6/2001 | Lin et al. | |
| 6,656,650 | B1 * | 12/2003 | Lin et al. | 430/56 |
| 6,890,693 | B1 * | 5/2005 | Zhu et al. | 430/58.45 |

* cited by examiner

*Primary Examiner*—John L Goodrow
(74) *Attorney, Agent, or Firm*—Oliff & Berridge, PLC

(57) ABSTRACT

According to the present invention is an electrophotographic imaging member which is a thin dual layer structure comprising a top layer of a durable and wear-resistant layer and a bottom layer which is bipolar. The electrophotographic imaging member of the invention may be top surface charge generating or bottom surface charge generating and in either case has an overall negative charging mode of operation.

37 Claims, No Drawings

ELECTROPHOTOGRAPHIC IMAGING MEMBERS

FIELD OF THE INVENTION

The present invention relates generally to electrophotographic imaging members and, more specifically, to dual layered photoreceptor structures and processes for making and using such.

BACKGROUND OF THE INVENTION

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

Multi-layered photoreceptors are known and described for example in U.S. Pat. Nos. 6,207,334, 6,197,464 and 6,242,144 (the disclosures of which are incorporated herein by reference). Such multi-layered photoreceptor structures are typically fabricated with a flexible or rigid substrate that is provided with an electrically conductive surface. A charge generating layer is then applied to the electrically conductive surface. A charge blocking layer may optionally be applied to the electrically conductive surface prior to the application of a charge generating layer. An adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

Multilayer photoreceptors employing overcoatings of a crosslinked polyamide matrix are also known. For example, U.S. Pat. No. 5,702,854 to Schank discloses an electrophotographic imaging member that includes a supporting substrate coated with at least a charge generating layer, a charge transport layer and an overcoating layer, the overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine.

U.S. Pat. No. 5,709,974 discloses an electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound.

U.S. Pat. No. 5,368,967 discloses an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials include Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane.

U.S. Pat. No. 4,871,634 discloses an electrostatographic imaging member which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,457,994 discloses a layered photosensitive member comprising a generator layer and a transport layer containing a diamine type molecule dispersed in a polymeric binder and an overcoat containing triphenyl methane molecules dispersed in a polymeric binder.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof.

U.S. Pat. No. 5,418,107 discloses a process for fabricating an electrophotographic imaging member including providing a substrate to be coated, forming a coating comprising photoconductive pigment particles having an average particle size of less than about 0.6 micrometers dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

Single layer organic photoreceptors are also known. Such photoreceptors typically comprise a flexible or rigid substrate, which is provided with an electrically conductive surface. A relatively thick layer (over 30 microns) with combined charge transport molecules and charge generating pigments dispersed throughout the layer is applied to the substrate. The absorption and photogeneration in the single layer being concentrated near the top surface, and the associated absence of a pigment layer proximate to the substrate, renders the single layer organic photoreceptor superior to its multi-layer counterparts. For instance, the single layer photoreceptor has greater resolution because the image forming charge-packet does not have to traverse the entire thickness of the photoreceptor and therefore, does not spread. The single layer photoreceptor is also not susceptible to image plywood (an image defect seen in prints that is attributed to light interference which may be caused by light reflection off the substrate) since more light is absorbed by the photoreceptor, especially near the top surface. Therefore, the single layer photoreceptor does not require undercoat layers with light-scattering particles, substrate lathing and other substrate surface treatments to effect light scattering, or other plywood remedies currently employed on substrates. The single layer photoreceptor is also less susceptible to charge injection from the substrate to the pigment since there is no concentrated pigment layer next to the substrate and thus, does not require a charge (hole) blocking layer.

While more advantageous than multilayer photoreceptors, single layer photoreceptors do suffer from poor electron transport through the bulk of the relatively thick photoreceptor (30–40 microns). Further, single layer photoreceptors are positive charging. In order to comply with the predominantly negative charging development processes for most printers and copiers, there is a need for a negative charging photoreceptor having characteristics advantages of the single layer photoreceptor. There is also a need for a photoreceptor that has a lower unit manufacturing cost than current multi-layer designs, has improved wear rates, and allows for an overall thinner photoreceptor that enhances resolution.

SUMMARY OF THE INVENTION

It is a feature of the present invention to provide a dual layer photoreceptor that has similar resolution to that of a single layer photoreceptor.

It is another feature of the present invention to provide a dual layer photoreceptor that is also not susceptible to image plywood since more light is absorbed by the photoreceptor, especially near the top surface.

It is another feature of the present invention to provide a dual layer photoreceptor that does not require undercoat layers with light-scattering particles, substrate lathing and other substrate surface treatments to effect light scattering, or other plywood remedies currently employed on substrates.

It is another feature of the present invention to provide a dual layer photoreceptor that is also less susceptible to charge injection from the substrate to the pigment since there is no concentrated pigment layer next to the substrate and thus, does not require a charge (hole) blocking layer.

It is another feature of the present invention to provide a dual layer photoreceptor that, unlike current bottom-generating designs, does not require an undercoat layer.

It is another feature of the present invention to provide a dual layer photoreceptor that has high resolution at current wear targets of known overcoatings of photoreceptors of the art.

It is another feature of the present invention to provide a dual layer photoreceptor that is simpler in design than the multi-layer photoreceptors of the art.

It is another feature of the present invention to provide a dual layer photoreceptor that does not require a charge blocking layer.

It is another feature of the present invention to provide a dual layer photoreceptor that has a lower UMC (Unit Manufacturing Cost) than the multi-layer photoreceptors of the art.

It is another feature of the present invention to provide a dual layer photoreceptor that may be used for both belt and drum applications for high resolution devices.

It is another feature of the present invention to provide a dual or tri-layer photoreceptor with a longer life as compared to their multi-layer counterparts.

It is another feature of the present invention to provide a photoreceptor with improved coatability since the thick, bottom layer is easier to coat than thin charge generating layers of the prior art.

It is a feature of the present invention to provide an overall thinner photoreceptor, which enhances resolution.

In aspects of the invention it is a feature to provide a bottom layer that is a thick dual-function charge generation and charge transport layer that distributes a pigment throughout the thick layer which avoids substrate injection and therefore eliminates the need for an undercoating layer.

In aspects of the invention it is a feature to provide a bottom layer that is a thick dual-function charge generation and charge transport layer that distributes a pigment throughout the thick layer which decreases charge deficient spot print defects.

In aspects of the invention it is another feature to provide a bottom layer that is a thick dual-function charge generation and charge transport layer whereby plywood is suppressed as light is more efficiently absorbed in the thick, bottom layer.

According to the present invention is a photoreceptor having a thin dual layer structure. The thin dual layer structure comprises a top layer of a durable cross-linked layer and a bottom layer which is bipolar. The thin photoreceptor of the invention may be top surface charge generating or bottom surface charge generating and in either case has an overall negative charging mode of operation.

According to another aspect of the invention is a photoreceptor comprising a top durable layer that is charge generating and/or charge transporting; and a bottom layer that is bipolar charge transporting or bipolar charge generating layer. In aspects, the photoreceptor has a negative charging mode of operation. In further aspects are methods for making such photoreceptors.

In one embodiment of the invention, the durable top layer acts as a charge generating layer (CGL) and may also have a dual function as a charge transport layer (CTL). The top layer has a thickness of up to about 10 microns, and in some aspects about 2.0 to about 7.0 microns. In this embodiment, the bottom layer is a relatively thick bipolar CTL of up to about 15 microns and in some aspects about 8 to about 12 microns.

In another embodiment of the invention, the durable top layer functions as a CTL having a thickness of up to about 10 microns. The top layer is positive charge transporting or may be bipolar. The bottom layer is a relatively thick bipolar CGL having a thickness of up to about 15 microns and in some aspects about 8.0 to about 15 microns. In this embodiment of the invention, a thin bipolar or hole transport CTL may further be provided between the thick bipolar CGL and the top layer. The thickness of the top layer in this aspect is less than that for the dual layer photoreceptor.

According to another aspect of the invention is a method for making a photoreceptor comprising providing a top durable layer that is charge generating and/or charge transporting; and providing a bottom layer that is bipolar charge transporting or bipolar charge generating layer. The photoreceptor in aspects is provided on a suitable substrate.

DETAILED DESCRIPTION OF THE INVENTION

There is developed a dual layer photoreceptor which is thin, simple and more cost effective to fabricate than conventional multilayered structures and possesses good resolution qualities comparable to single layered imaging members.

The present invention is photoreceptor which is a thin dual layer structure. The thin dual layer structure comprises a top layer of a durable and wear-resistant layer and a bottom layer which is bipolar. The thin electrophotographic imaging member of the invention may be top surface charge generating or bottom surface charge generating and in either case has an overall negative charging mode of operation.

In all embodiments, the top layer is durable (i.e. wear-resistant) and comprises a binder. This durable layer is further formulated to be charge generating and/or charge transporting. The bottom layer is formulated as a bipolar charge transporting or bipolar charge generating layer.

In a first embodiment of the present invention, the photoreceptor is a top surface generating photoreceptor comprising a thin top layer of a durable, cross-linkable binder that has a dual-function charge generation and charge transport function. The top layer has a thickness of up to about 10 microns and some aspects about 2.0 to 7.0 microns. The durability of this thin layer is provided by the cross-linkable binder that has been used as a "top coat" in conventional multilayer photoreceptor structures. The thinness of this top layer allows for better electron transport. The thin top layer also functions to decrease the wear requirements on the charge transport layer and enables the use of less binder and/or lower molecular weight binders in the charge transport bottom layer. The bottom layer comprises a partly bipolar charge transport layer of thickness of up to about 15 microns and in some aspects about 8 to 12 microns. This layer has sufficient electron transport capability because it is protected by the top layer and so it is allowed to contain higher loadings of hole transport molecules (HT) and electron transport molecules (ET).

This first top surface charge generating embodiment has the properties of the single layer photoreceptor design in that it has a greater resolution, is not susceptible to image plywood and less susceptible to charge injection from the substrate to the pigment and does not require a charge (hole) blocking layer.

According to this first embodiment, the top layer comprises a dispersion of about 5 to 15% pigment by weight of the total solid layer, about 50–60% binder by weight of the total solid layer, about 15–35% of coating solution weight as solvent and about a 3:2 ratio of hole transport molecules to electron transport molecules, the total transport molecules being about 20–30% by weight of the solid layer. The binder used in the top layer is preferably cross-linkable and soluble in alcohol which enables coating onto the bottom layer without admixing of layers. The cross-linkable binder may be used in combination with other binders.

The bottom layer comprises up to about 50% by weight of the total layer of hole transport molecules and electron transport molecules in about 1040% by weight binder and about 75–95% by weight solvent. Overall, the solid content in solvent solution is about 5–25% by weight of the coating solution.

According to a second embodiment of the present invention, the thin dual layer photoreceptor is a bottom generating photoreceptor comprising a top layer that functions as a charge transport layer that is more durable than the lower layer since the top layer does not contain pigment, and is up to about 10 microns in thickness. The binder of the top layer can be a durable cross-linkable binder for additional wear resistance if desired. The bottom layer is a bipolar charge generator layer of up to about 15 microns in thickness and in some aspects about 8–15 microns in thickness.

The cross-linkable binder of the top layer is soluble in alcohol which enables coating onto the bottom layer without admixing of layers. This is more important in this second embodiment of the invention in order not to disturb the bipolar function of the bottom layer CGL. If the top layer is soluble in the same solvent as the bottom layer, then the same ratio of hole transport molecules to electron transport molecules is used in both top and bottom layers so as to maintain the bipolar function of the bottom layer.

The thick bottom CGL distributes pigment throughout a thicker layer than currently known multilayer charge generating designs thus avoiding substrate injection and eliminates the need for undercoat layers which may be incorporated if desired. The pigment distribution of the bottom layer CGL also helps to decrease charge deficient spots print defect and suppress plywood effects due to the efficient absorption of light in this layer. This layer is also easier to coat onto a suitable substrate than the very thin (less than 1.0 micron) CGL's currently used. Lastly, the present thick bottom CGL layer enables the use of a thinner top charge transport layer which increases resolution. The bipolar transport matrix of the thick bottom layer CGL provides good transport of both holes and electrons. Overall, this dual layer embodiment demonstrates improved electron transport therein over the thick single layer structures currently used that are positive charging.

According to the second embodiment, the top durable layer that functions as a CTL comprises a dispersion of about 50–70% by weight of charge transport molecules (hole transport and electron transport molecules), about 30–50% by weight binder and solvent, where the solvent content of the coating solution is in the range of about 15–35% by weight of the coating solution.

The bipolar thick bottom CGL layer comprises about 2–20% by weight pigments of total solids, about 40–78% by weight charge transport molecules of total solids and about 20–40% by weight binder. With respect to the charge transport molecules these include both hole transport molecules and electron transport molecules in a ratio in a range of about 3:2 to 4:1 by weight, respectively, depending on the combination of the hole and electron transport molecules used as is understood by one of skill in the art. The total concentration of charge transport molecules is important to obtain sufficient electron transport at a given thickness.

The pigments suitable for use in embodiments of the present invention in both top and bottom layers may be selected from but not limited to hydroxygallium phthalocyanine (HOGaPC), x metal-free phthalocyanine (x-$H_2$PC), benzylimidizo perylene (BZP) and 535+dimer. Mixtures of pigments may also be used as is understood by one of skill in the art. Perylene pigments are preferred to improve electron transport capability in the CGL as these pigments are extrinsic charge generators with known e-transport ability in pure, undiluted form.

The durable binders for use in embodiments of the invention in both the top and bottom layers may be selected from any suitable and compatible binders with the hole and electron transport molecules as used in the layers as is understood by one of skill in the art. Preferred binders are bisphenol-Z polycarbonate (PCZ); PCZ-500 (avg. mol. wgt. 51,000); PCZ-400 (avg. mol. wgt 40,000); cross-linkable polymers such as a polyamide, for example LUCKAMIDE® or ELVAMIDE®; mTBD-based polymer; e-transport polymers and mixtures thereof. A polyamide polymer such as LUCKAMIDE®, is a preferred binder (used either alone or in combination with other binders) for use in the top layer of the present invention.

The hole transport molecules for use in embodiments of the invention in the top and bottom layers may be selected from but not limited to N,N'-diphenyl-N,N'-bis(3-hydroxyphenyl)-[1,1'-biphenyl]-4,4'-diamine (DHTBD); N,N'-diphenyl-N,N'-bis(alkylphenyl)-1,1-biphenyl-4,4'-diamine (mTBD); Tri-p-tolylamine (TTA); N,N'-bis-(3,4-dimethylphenyl)-4-biphenylamine (Ae-18); N,N'-bis(4-methylphenyl)-N,N'-bis(4-ethylphenyl)-11'-3,3'-dimethylbiphenyl)-4,4'diamine (AB-16); and mixtures thereof. In the case of DHTBD, it is most preferred that this hole transport molecule be restricted to the top layer of the first embodiment of the invention.

The electron transport molecules for use in embodiments of the invention in the top and bottom layers may be selected from but not limited to N,N'-bis(1,2-dimethylpropyl)-1,4,5,8-naphthalenetetracarboxylic diimide (NTDI) and modified NTDI's for higher solubility; 1,1'-dioxo-2-(4-methylphenyl)-6-phenyl-4-(dicyanomethylidene)thiopyran (PTS); butylcarboxylate fluorenone malononitrile (BCFM); 2-ethylehexylcarboxylate fluorenone malononitrile (2EHCFM); 1,1-(N,N'-bisalkyl-bis-4-phthalimido)-2,2-biscyano-ethylenes (BIB-CNs) and mixtures thereof.

Solvents for use in embodiments of the invention in the layers of the photoreceptor may be selected from but not limited to tetrahydrofuran (THF), toluene, methylene chloride, monochlorobenzene (MCB), cyclohexanone, alchohols and mixtures thereof. Alcohols are preferred for use with the LUCKAMIDE® cross-linkable polymer for use in the top durable layer of the invention. It is preferred that tetrahydrofuran (THF) and monochlorobenzene (MCB) are used as the solvent for the bottom CTL of the first embodiment of the invention. As understood by one of skill in the art, the solvent is provided in the solution used to make the layers, provided as coatings. Thus solvent content is by weight of the coating solution.

In a further aspect of the second embodiment of the invention, a thin bipolar or hole transport CTL layer may be provided between the thick bipolar bottom CGL layer and the top CTL functioning durable layer. In this aspect, the top durable layer is up to about 10 microns and in some aspects about 1–5 microns such that the transport demands on this layer are decreased. The composition of the "insertion" layer is the same as that for the thick bipolar CGL without the pigments which are the charge generators. The thickness of the insertion layer is from about 10–15 microns.

The photoreceptors of the present invention may be prepared by any suitable technique. Typically, a flexible or rigid substrate with an electrically conductive surface is used as a base for photoreceptors.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors as is understood by one of skill in the art. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafrium, titanium, nickel, stainless steel, chromium, tungsten, molybdenum, and the like.

Any suitable and conventional technique may be utilized to mix and thereafter apply the bottom layers of the invention to a selected substrate. Typical application techniques include spraying, dip coating, roll coating, wire wound rod coating, and the like. Drying of the deposited coating may be effected by any suitable conventional technique such as oven drying, infra red radiation drying, air drying and the like.

Any suitable and conventional technique may be utilized to mix and thereafter apply the top layers of the invention. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The following Examples are being submitted to illustrate embodiments of the present invention. These Examples are intended to be illustrative only and are not intended to limit the scope of the present invention.

EXAMPLES

A number of examples are set forth herein below and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

Example 1

Representative compositions for the top and bottom layers of a first embodiment of the invention are as follows:

| #1 | #2 | #3 | #4 |
|---|---|---|---|
| (A) Top Layer (5.5–7.0 μm) Dispersion of: | | | |
| 5% x-H2Pc or OHGaPc<br>5% PCZ<br>45% luckamide<br>(3:2 ratio of HT:ET) | 10% xH2Pc or OHGaPc<br>5% PCZ<br>45% luckamide | 5% BZP<br>5% PCZ<br>60% luckamide | 10% BZP<br>10% PCZ<br>50% luckamide |
| 27% TTA / DHTBD<br>18% NTDI | 24% TTA /DHTBD<br>16% NTDI | 18% TTA/DHTBD<br>12% NTDI | 18% TTA/DHTBD<br>12% NTDI |
| Bottom Layer (10–12 μm) | | | |
| 42% TTA<br>28% NTDI<br>30% PCZ | 42% TTA<br>28% NTDI<br>30% PCZ | 42% TTA<br>28% NTDI<br>30% PCZ | 42% TTA<br>28% NTDI<br>30% PCZ |
| (Hole transport or electron transport binders may be used in this bottom layer as can $TiO_2$ particles.) | | | |
| (B) Top Layer (5.0–7.0 μm) Dispersion of: | | | |
| 5% x-H2Pc or OHGaPc<br>5% PCZ<br>45% luckamide<br>(4:1 ratio of HT:ET) | 10% xH2Pc or OHGaPc<br>5% PCZ<br>45% luckamide | 5% BZP<br>5% PCZ<br>60% luckamide | 10% BZP<br>10% PCZ<br>50% luckamide |
| 36% Ae18<br>9% BCFM | 32% Ae18<br>8% BCFM | 24% Ae18<br>6% BCFM | 24% Ae18<br>6% BCFM |
| Bottom Layer (10–12 μm) | | | |
| 56% Ae18<br>14% BCFM<br>30% PCZ | 56% Ae18<br>14% BCFM<br>30% PCZ | 56% Ae18<br>14% BCFM<br>30% PCZ | 56% Ae18<br>14% BCFM<br>30% PCZ |

Example 2

Representative compositions for the top and bottom layers of a second embodiment of the invention are as follows:

| #1 | #2 | #3 | #4 |
|---|---|---|---|
| Top Layer (5.0–10.0 μm) | | | |
| 10% PcZ<br>45% luckamide<br>(3:2 ratio of HT:ET)<br>27% TTA/DHTBD<br>18% NTDI | 10% PcZ<br>50% luckamide<br>(4:1 ratio of HT:ET)<br>32% Ae18<br>8% BCFM | 60% PCZ 500<br>(4:1 ratio of HT:ET)<br>32% Ae18<br>8% BCFM | 70% PcZ 500<br>(4:1 ratio of HT:ET)<br>24% Ae18<br>6% BCFM |
| Bottom Layer (8–12 μm) | | | |

| For composition #1: | For compositions #2, #3 and #4 |
|---|---|
| 5% x-$H_2$Pc or OHGaPc<br>33% TTA<br>22% NTDI<br>40% PcZ | 5% x-$H_2$Pc or OHGaPc<br>44% Ae18<br>11% BCFM<br>40% PcZ |

Although the invention has been described with reference to specific preferred embodiments, it is not intended to be limited thereto, rather those having ordinary skill in the art will recognize that variations and modifications may be made therein which are within the spirit of the invention and within the scope of the claims.

The invention claimed is:

1. A photoreceptor comprising a substrate;

a top durable layer that is charge generating and/or charge transporting; and a bottom layer that is bipolar charge transporting or bipolar charge generating, wherein the photoreceptor has a negative charging mode of operation.

2. The photoreceptor of claim 1, wherein said top durable layer has a thickness of up to about 10 microns.

3. The photoreceptor of claim 2, wherein said top durable layer has a thickness of about 2.0 to about 7.0 microns.

4. The photoreceptor of claim 1, wherein said top durable layer is both charge generating and charge transporting.

5. The photoreceptor of claim 4, wherein said top durable layer comprises a dispersion of about 5–15% pigment by weight of the total solid layer, about 50–60% by weight binder of the total solid layer, about 10–30% of total coating solution weight as solvent and about a 3:2 ratio of hole transport molecules to electron transport molecules.

6. The photoreceptor of claim 5, wherein the hole transport molecules and electron transport molecules are about 20–30% by weight of the total solid layer.

7. The photoreceptor of claim 5, wherein said pigment is selected from hydroxygallium phthalocyanine (HOGaPC), x metal-free phthalocyanine (x-$H_2$PC), benzylimidizo perylene (BZP) and mixtures thereof.

8. The photoreceptor of claim 5, wherein said binder is selected from bisphenol-Z polycarbonate (PCZ), PCZ-500 (avg. mol. wgt. 51,000), PCZ-400 (avg. mol. wgt 40,000), polyamide polymer, mTBD-based polymer, e-transport polymers and mixtures thereof.

9. The photoreceptor of claim 8, wherein said binder is the polyamide polymer.

10. The photoreceptor of claim 5, wherein said solvent is selected from tetrahydrofuran (THF), toluene, methylene chloride, monochlorobenzere (MCB), cyclohexane, alcohols and mixtures thereof.

11. The photoreceptor of claim 5, wherein said hole transport molecules are selected from N,N'-diphenyl-N,N'-bis(3-hydroxyphenyl)-[1,1'-biphenyl]-4,4'-diamine (DHTBD); N,N'-diphenyl-N,N'-bis(alkylphenyl)-1,1-biphenyl-4,4'-diamine (mTBD); Tri-p-tolylamine (TTA); N,N'-bis-(3,4-dimethylphenyl)-4-biphenylamine (Ae-18); N,N'-bis(4-methylphenyl)-N,N'-bis(4-ethylphenyl)-11'-3,3'-dimethylbiphenyl)-4,4'diamine (AB-16); and mixtures thereof.

12. The photoreceptor of claim 5, wherein said electron transport molecules are selected from N,N'-bis(1,2-dimethylpropyl)-1,4,5,8-naphthalenetetracarboxylic diimide (NTDI) and modified NTDI's for higher solubility; 1,1'-dioxo-2-(4-methylphenyl)-6-phenyl-4-(dicyanomethylidene)thiopyran (PTS); butylcarboxylate fluorenone malononitrile (BCFM); 2-ethylehexylcarboxylate fluorenone malononitrile (2EHCFM), 1,1-(N,N'-bisalkyl-bis-4-phthalimido)-2,2-biscyano-ethylenes (BIB-CNs) and mixtures thereof.

13. The photoreceptor of claim 4, wherein said bottom layer is a bipolar charge transport layer.

14. The photoreceptor of claim 13, wherein said bottom layer has a thickness of up to about 15 microns.

15. The photoreceptor of claim 14, wherein said thickness is about 8 to 12 microns.

16. The photoreceptor of claim 13, wherein said bottom layer comprises up to about 50% by weight of the total layer of hole transport molecules and electron transport molecules, about 10–40% by weight binder and about 75–95% by weight solvent by weight of the dispersion.

17. The photoreceptor of claim 16, wherein said binder is selected from bisphenol-Z polycarbonate (PCZ), PCZ-500 (avg. mol. wgt. 51,000), PCZ-400 (avg. mol. wgt 40,000), polyamide polymer, mTBD-based polymer, e-transport polymers and mixtures thereof.

18. The photoreceptor of claim 16, wherein said solvent is selected from tetrahydrofuran (THF), toluene, methylene chloride, monochlorobenzere (MCB), cyclohexane, alcohols and mixtures thereof.

19. The photoreceptor of claim 16, wherein said hole transport molecules are selected from N,N'-diphenyl-N,N'-bis(3-hydroxyphenyl)-[1,1'-biphenyl]-4,4'-diamine (DHTBD); N,N'-diphenyl-N,N'-bis(alkylphenyl)-1,1-biphenyl-4,4-diamine (mTBD); Tri-p-tolylamine (TTA); N,N'-bis-(3,4-dimethylphenyl)-4-biphenylamine (Ae-18); N,N'-bis(4-methylphenyl)-N,N'-bis(4-ethylphenyl)-11'-3,3'-dimethylbiphenyl)-4,4'diamine (AB-16); and mixtures thereof.

20. The photoreceptor of claim 16, wherein said electron transport molecules are selected from N,N'-bis(1,2-dimethylpropyl)-1,4,5,8-naphthalenetetracarboxylic diimide (NTDI) and modified NTDI's for higher solubility; 1,1'-dioxo-2-(4-methylphenyl)-6-phenyl-4-(dicyanomethylidene)thiopyran (PTS); butylcarboxylate fluorenone malononitrile (BCFM); 2-ethylehexylcarboxylate fluorenone malononitrile (2EHCFM), 1,1-(N,N'-bisalkyl-bis-4-phthalimido)-2,2-biscyano-ethylenes (BIB-CNs) and mixtures thereof.

21. The photoreceptor of claim 1, wherein said top layer is a charge transport layer and the bottom layer is bipolar charge generating.

22. The photoreceptor of claim 21, wherein said top layer has a thickness of up to about 10 microns.

23. The photoreceptor of claim 21, wherein said top layer comprises a dispersion of about 50–70% by weight charge transport molecules, about 30–50% by weight binder and about 15–25% by weight of solvent by weight of the dispersion.

24. The photoreceptor of claim 23, wherein said charge transport molecules are hole transport molecules and electron transport molecules, the hole transport molecules are selected from N,N'-diphenyl-N,N'-bis(3-hydroxyphenyl)-[1,1'-biphenyl]-4,4'-diamine (DHTBD), N,N'-diphenyl-N,N'-bis(alkylphenyl)-1,1-biphenyl-4,4'-diamine (mTBD), tri-p-tolylamine (TTA); N,N'-bis-(3,4-dimethylphenyl)-4-biphenylamine (Ae-18), N,N'-bis(4-methylphenyl)-N,N'-bis(4-ethylphenyl)-11'-3,3'-dimethylbiphenyl)-4,4'diamine (AB-16), and mixtures thereof; and said electron transport molecules are selected from N,N'-bis(1,2-dimethylpropyl)-1,4,5,8-naphthalenetetracarboxylic diimide (NTDI) and modified NTDI's for higher solubility; 1,1'-dioxo-2-(4-methylphenyl)-6-phenyl-4-(dicyanomethylidene)thiopyran (PTS); butylcarboxylate fluorenone malononitrile (BCFM); 2-ethylehexylcarboxylate fluorenone malononitrile (2EHCFM), 1,1-(N,N'-bisalkyl-bis-4- phthalimido)-2,2-biscyano-ethylenes (BIB-CNs) and mixtures thereof.

25. The photoreceptor of claim 23, wherein said binder is selected from bisphenol-Z polycarbonate (PCZ), PCZ-500 (avg. mol. wgt. 51,000), PCZ-400 (avg. mol. wgt 40,000), polyamide polymer, mTBD-based polymer, e-transport polymers and mixtures thereof.

26. The photoreceptor of claim 23, wherein said solvent is selected from tetrahydrofuran (THF), toluene, methylene chloride, monochlorobenzere (MCB), cyclohexane, alcohols and mixtures thereof.

27. The photoreceptor of claim 21, wherein said bottom layer is a bipolar charge generating layer.

28. The photoreceptor of claim 27, wherein said bottom layer has a thickness of up to about 15 microns.

29. The photoreceptor of claim 28, wherein said bottom layer has a thickness of about 8–15 microns.

30. The photoreceptor of claim 27, wherein said bottom layer comprises about 2–20% by weight pigments of total solids, about 40–78% by weight charge transport molecules and about 20–40% by weight binder.

31. The photoreceptor of claim 30, wherein said pigment is selected from hydroxygallium phthalocyanine (HOGaPC), x metal-free phthalocyanine (x-$H_2$PC), benzylimidizo perylene (BZP) and mixtures thereof.

32. The photoreceptor of claim 30, wherein charge transport molecules are hole transport molecules and electron transport molecules, the hole transport molecules are selected from N,N'-diphenyl-N,N'-bis(3-hydroxyphenyl)-[1,1'-biphenyl]-4,4'-diamine (DHTBD), N,N'-diphenyl-N,N'-bis(alkylphenyl)-1,1-biphenyl-4,4'-diamine (mTBD), Tri-p-tolylamine (TTA); N,N'-bis-(3,4-dimethylphenyl)-4-biphenylamine (Ae-18), N,N'-bis(4-methylphenyl)-N,N'-bis(4-ethylphenyl)-11'-3,3'-dimethylbiphenyl)-4,4'diamine (AB-16), and mixtures thereof and said electron transport molecules are selected from N,N'-bis(1,2-dimethylpropyl)-1,4,5,8-naphthalenetetracarboxylic diimide (NTDI) and modified NTDI's for higher solubility, 1,1'-dioxo-2-(4-methylphenyl)-6-phenyl-4-(dicyanomethylidene)thiopyran (PTS), butoxy carbonyl fluorenylidene malononitrile (BCFM), BIB-CNs and mixtures thereof.

33. The photoreceptor of claim 30, wherein said binder is selected from bisphenol-Z polycarbonate (PCZ), PCZ-500 (avg. mol. wgt. 51,000), PCZ-400 (avg. mol. wgt 40,000), polyamide polymer, mTBD-based polymer, e-transport polymers and mixtures thereof.

34. The photoreceptor of claim 21, wherein said photoreceptor additionally comprises a thin bipolar or hole transport charge transport layer having a thickness of up to 10 microns between said top and bottom layers.

35. The photoreceptor of claim 34, wherein said top layer has a thickness of about 1 to 5 microns.

36. A top surface charge generating photoreceptor comprising:

a top charge generation and charge transport layer; and a bottom bipolar charge transport layer.

37. A bottom charge generating photoreceptor comprising:

a top charge transport layer; and a bipolar charge generating layer.

* * * * *